US009068421B2

(12) United States Patent
Colby

(10) Patent No.: US 9,068,421 B2
(45) Date of Patent: Jun. 30, 2015

(54) MOLDED WELL HEAD COVER

(71) Applicant: Q.E.D. Environmental Systems, Inc., Ann Arbor, MI (US)

(72) Inventor: Douglas D. Colby, Clarkston, MI (US)

(73) Assignee: Graco Minnesota Inc., Minneapolis, MN (US)

( * ) Notice: Subject to any disclaimer, the term of this patent is extended or adjusted under 35 U.S.C. 154(b) by 316 days.

(21) Appl. No.: 13/658,433

(22) Filed: Oct. 23, 2012

(65) Prior Publication Data

US 2014/0110099 A1 Apr. 24, 2014

(51) Int. Cl.
*E21B 33/03* (2006.01)

(52) U.S. Cl.
CPC ..... *E21B 33/03* (2013.01)

(58) Field of Classification Search
CPC ..... E21B 34/02; E21B 33/038; E21B 33/047; E21B 2033/005; E21B 33/03; E03B 5/06
See application file for complete search history.

(56) References Cited

U.S. PATENT DOCUMENTS

| | | | | | |
|---|---|---|---|---|---|
| 3,504,742 | A * | 4/1970 | Crawford | 166/75.13 |
| 4,015,072 | A | 3/1977 | Gillemot | |
| 4,180,101 | A | 12/1979 | Wegge | |
| 4,202,376 | A | 5/1980 | Forsell | |
| 4,405,161 | A * | 9/1983 | Young et al. | 285/80 |
| 4,842,060 | A | 6/1989 | Paulus | |
| 5,211,428 | A | 5/1993 | Emerson et al. | |
| 5,442,140 | A | 8/1995 | McGrane | |
| 5,616,841 | A | 4/1997 | Brookshire | |
| 5,701,953 | A | 12/1997 | Stecker et al. | |
| 5,967,235 | A | 10/1999 | Scott | |
| 6,105,669 | A | 8/2000 | Davis | |
| 6,502,632 | B1 | 1/2003 | Pittman | |
| 6,591,695 | B1 | 7/2003 | Brookshire et al. | |
| 7,231,968 | B2 | 6/2007 | Owens | |
| 2005/0103497 | A1 * | 5/2005 | Gondouin | 166/302 |

* cited by examiner

*Primary Examiner* — Cathleen Hutchins
(74) *Attorney, Agent, or Firm* — Harness, Dickey & Pierce, P.L.C.

(57) ABSTRACT

A well head cover includes a polymeric body integrally including a tubular shaped main body portion. A tubular shaped mounting portion extends from the main body portion. A tubular shaped discharge portion is connected to the main body portion and is oppositely directed with respect to the mounting portion. A first discharge tube bore is created through a first end wall provided in the discharge portion. A second end wall is provided in the mounting portion. The second end wall has an end wall portion through which a second discharge tube bore is created. An axial centerline of the second discharge tube bore is coaxially aligned with an axial centerline of the first discharge tube bore. A pipe extending through the well head cover has a diameter adapted to provide a sliding fit with the first and second end walls at the first and second discharge tube bores.

26 Claims, 8 Drawing Sheets

MOLDED WELL HEAD COVER

FIELD

The present disclosure relates to well head covers used for wells of landfill sites which are used for extraction of methane gas which also support well instrumentation.

BACKGROUND

This section provides background information related to the present disclosure which is not necessarily prior art.

Known well head covers used in landfill and similar gas production wells have an exhaust sleeve through which a methane gas discharge pipe is led. The methane gas discharge pipe is the single largest service pipe or tube connected to the well head. Where multiple service ports are required, they are typically added downstream of the well head covers, or are tapped into the covers at different locations where the well head cover is not designed to provide direct support for the weight of components connected to the well head covers.

Known problems with existing well head covers include bending/deflection problems due to the provision of only a single discharge pipe support member that vertically supports the discharge pipe. With only a single sleeve or support flange the weight and moment of the methane gas discharge pipe and its associated valves and components can cause the components at the weld head to bend or sag. This can result in cracking and/or gas leakage of the discharge pipe or associated components, and/or disorientation of components such as an orifice plate assembly used for flow rate determination, which can lead to inaccurate flow measurements. In addition, due to the limited production volume of plastic well head covers for this service, well head cover material is commonly the same material as the well piping, therefore, the color of known well head covers is normally the same gray or pale white as the piping. Vehicles used to service the hundreds of wells of a common landfill often strike and therefore damage the well pipes because the vehicle drivers cannot visually distinguish the wells. Painting existing well head cover designs using a high visibility color is time consuming and expensive, and the paint often is degraded or peels due to the environmental conditions present at landfill operations.

SUMMARY

This section provides a general summary of the disclosure, and is not a comprehensive disclosure of its full scope or all of its features.

According to several aspects, a well head cover includes a polymeric body integrally including each of a mounting portion and a discharge portion connected to the main body portion. A first discharge tube bore is created through a first end wall provided in the discharge portion. The first end wall defines a first end of the well head cover. A second end wall provided in the mounting portion defines a second end of the well head cover spatially separated from the first end of the well head cover by an internal cavity. The second end wall has an end wall portion through which a second discharge tube bore is created. An axial centerline of the second discharge tube bore is coaxially aligned with an axial centerline of the first discharge tube bore.

According to other aspects, a well head cover includes a polymeric body integrally including a tubular shaped main body portion. A tubular shaped mounting portion extends from the main body portion. A tubular shaped discharge portion is connected to the main body portion and is oppositely directed with respect to the mounting portion. A first discharge tube bore is created through a first end wall provided in the discharge portion. A second end wall is provided in the mounting portion. The second end wall has an end wall portion through which a second discharge tube bore is created. An axial centerline of the second discharge tube bore is coaxially aligned with an axial centerline of the first discharge tube bore.

According to still other aspects, a pipe extending through the well head cover has a diameter adapted to provide a sliding fit with the first and second end walls at the first and second discharge tube bores. The coaxially aligned axial centerlines of the first and second discharge tube bores allow a common longitudinal centerline of the pipe to be coaxially aligned with the axial centerline of each of the first and second discharge tube bores, wherein direct contact between the pipe and both the first and second end walls prevents substantial displacement of the longitudinal centerline away from the axial centerlines of the first and second discharge tube bores.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
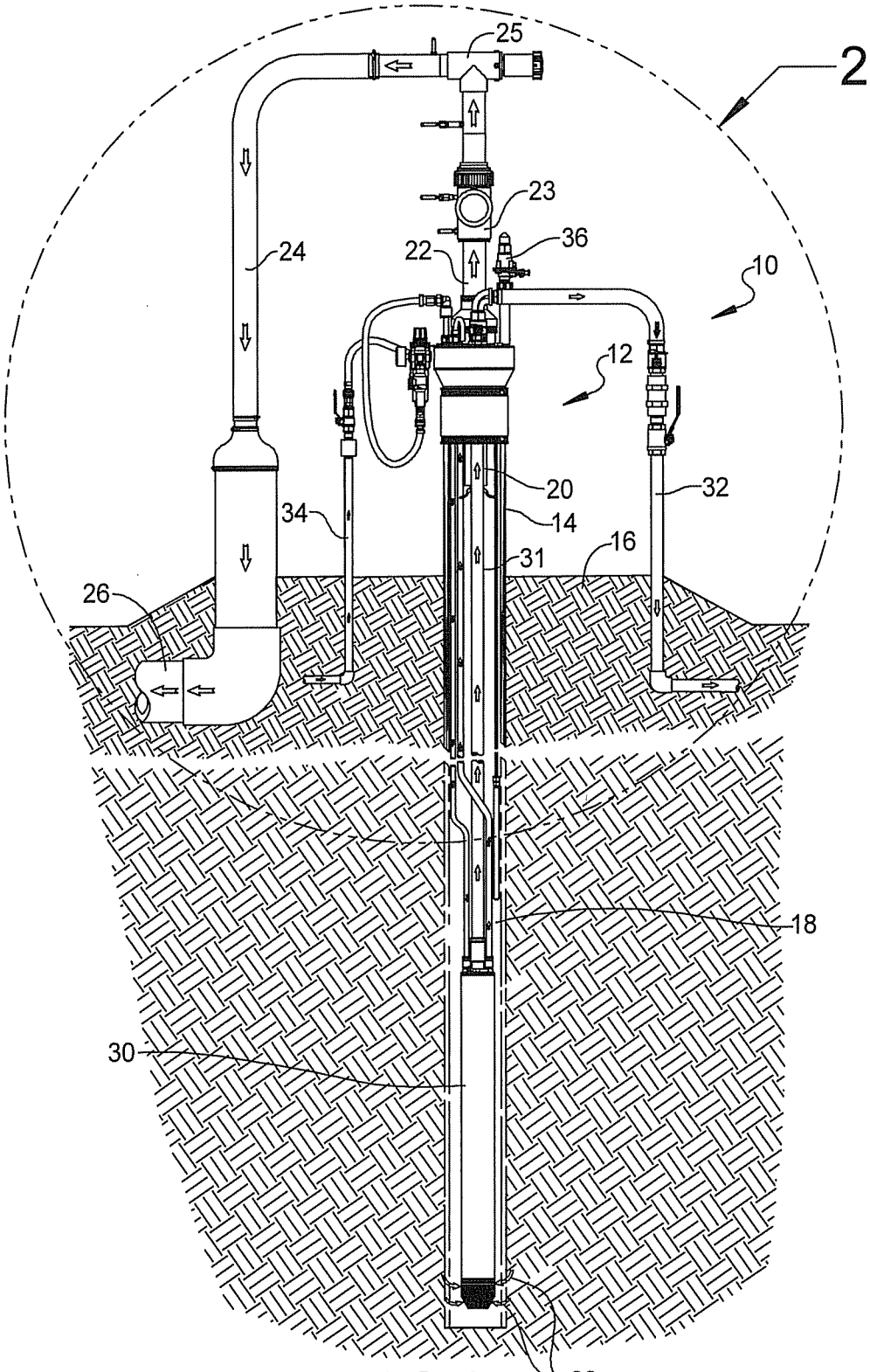
FIG. 1 is a partial cross sectional front elevational view of a landfill well assembly and associated equipment and piping having a well head cover of the present disclosure.

Referring to FIG. 1, a landfill well system 10 includes a well head assembly 12 which is mounted to a plastic well pipe 14, which is typically a six inch or eight inch pipe. Well pipe 14 extends approximately three to four feet above a ground level of a multiple layer landfill gradient 16. Well pipe 14 includes multiple holes 18 in a zone approximately extending thirty to over one hundred feet below the well surface that permit influx of methane gas into the well pipe 14. Methane gas rises into a well discharge pipe 20 that includes an above ground discharge pipe extension 22. The methane gas passes through multiple components including an orifice plate assembly 23 used to measure gas flow rate, and a control valve 25 used to meter gas flow rates, and is transferred via a flow pipe 24 to a larger collection pipe 26. Well head assembly 12 provides for, and landfill well system 10 can further include, a plurality of influent apertures 28 near the bottom end of well pipe 14 that allow liquid known as "leachate" to collect at the well pipe foot. Before reaching holes 18, the leachate is discharged using a pump 30 via an in-well fluid discharge pipe 31 and an external well fluid discharge pipe 32. Other services provided by well head assembly 12 include an air inlet line 34 and a well fluid level detector 36.

Figure 7:
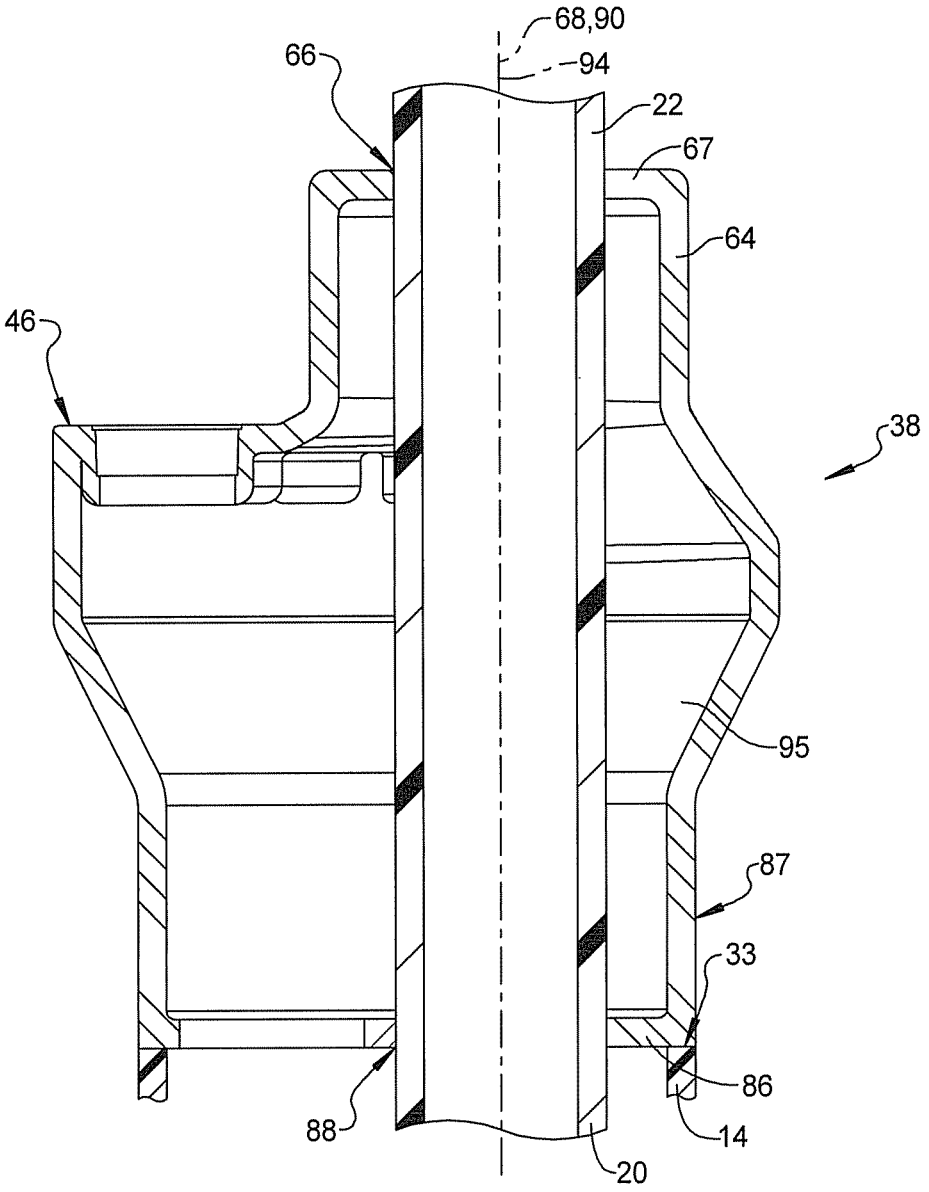
FIG. 7 is a cross sectional side elevational view taken at section 7 of FIG. 4.

Referring to FIG. 2 and again to FIG. 1, well head assembly 12 includes a well head cover 38 of the present disclosure which rests on an upper end face 33 (shown in FIG. 7) of well pipe 14. Well head cover 38 is retained in place using a commonly known flexible rubber boot fitting 40 using a first band strap 42 at the well pipe 14 and a second band strap 44 at the connection to well head cover 38. Well head cover 38 is therefore removable if desired by releasing first and second band straps 42, 44 and releasing well head cover 38 from boot fitting 40. In addition to directly supporting well discharge pipe 20 including its integrally connected discharge pipe extension 22, a polymeric body 45 of well head cover 38 includes an integrally connected cover service plate 46. Cover service plate 46 includes service ports for multiple services such as a bracket 48 retaining a filter/regulator 50 of the air supply system, a tube supporting well fluid level detector 36, and a connector for external well fluid discharge pipe 32. A supply air line 52 and an air discharge line 54 are also connected to cover service plate 46. It is also noted a reducer 56 such as a flexible rubber reducer can be connected at the discharge location of discharge pipe extension 22 to suit the diameter of flow pipe 24.

Figure 2:
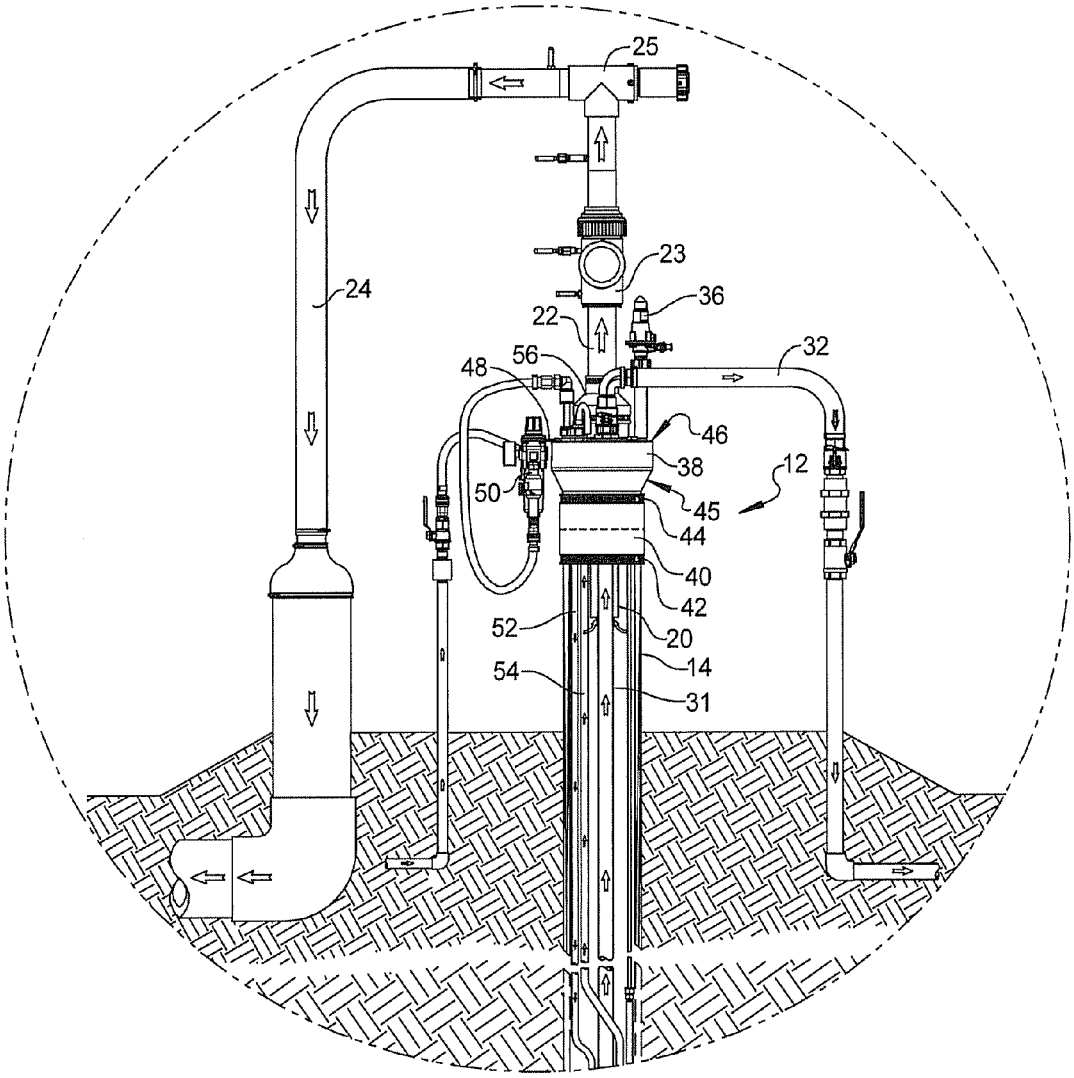
FIG. 2 is a partial cross sectional front elevational view of area 2 of FIG. 1.

Referring to FIG. 3 and again to FIGS. 1-2, well head cover 38 of a first aspect includes well head body 45 having a mounting portion 58 with a diameter "A" preferably substantially equal to a diameter of well pipe 14. A tapering or conical shaped portion 60 integrally joins mounting portion 58 to a larger diameter substantially tubular main body portion 62. A discharge portion 64 is integrally connected to main body portion 62 which internally receives and supports discharge pipe 20 and supports discharge pipe extension 22. The cover service plate 46 is located at a junction 65 between the main body portion 62 and discharge portion 64. Cover service plate 46 is substantially planar and is oriented substantially perpendicular to a longitudinal central axis 70 of well head cover 38.

Figure 3:
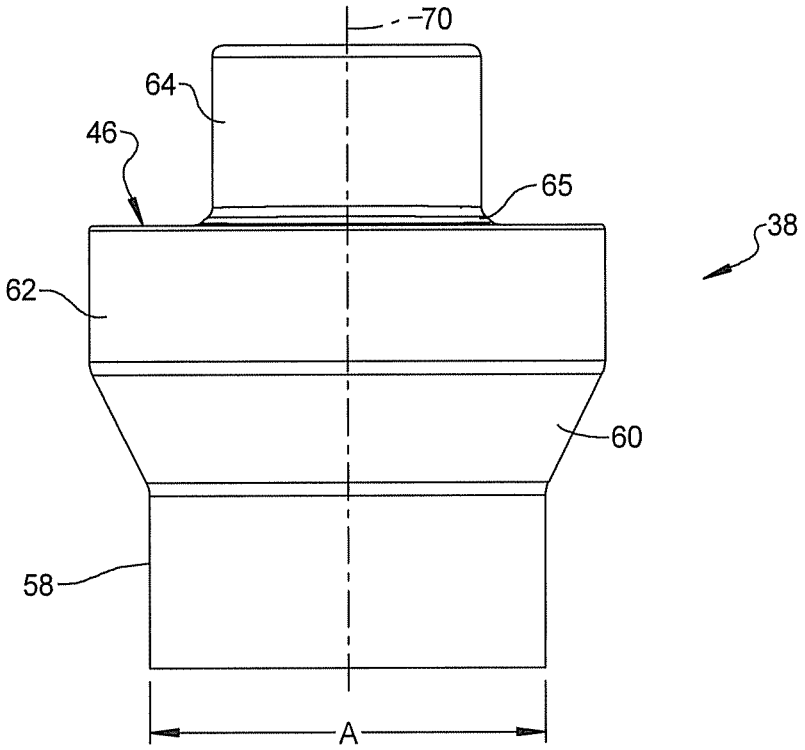
FIG. 3 is a front elevational view of a well head cover of the present disclosure.
Figure 4:
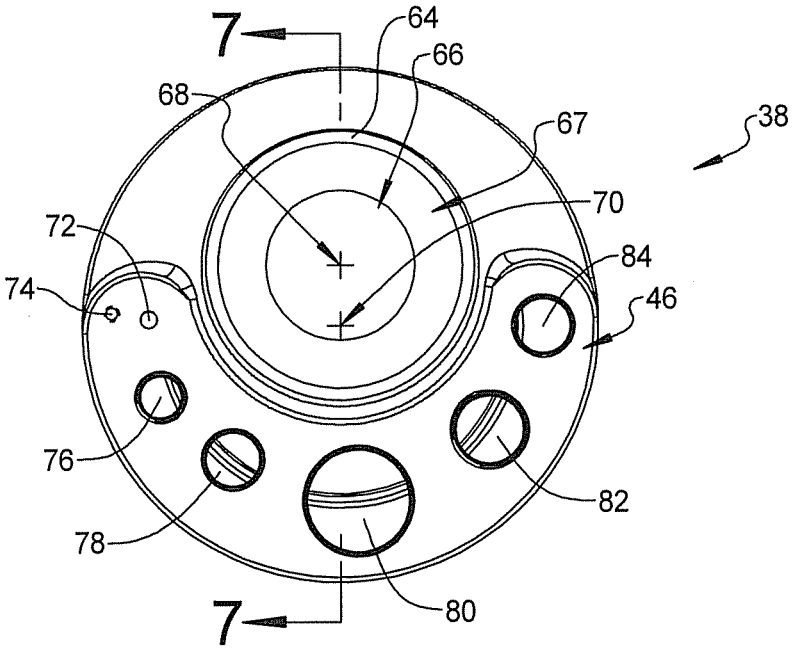
FIG. 4 is a top plan view of the well head cover of FIG. 3.

Referring to FIG. 4 and again to FIGS. 1-3, a first discharge tube bore 66 is created through a first end wall 67 of discharge portion 64. First end wall 67 defines a first end of well head cover 38. First discharge tube bore 66 has an axial centerline 68 offset or displaced with respect to central axis 70 of well head cover 38. The multiple service ports created in cover service plate 46 can include but are not limited to first and second threaded apertures 72, 74 which receive fasteners to mount bracket 48, an air inlet port 76, an air outlet port 78, a leachate discharge port 80, a differential pressure or liquid level probe port 82, and a manual liquid level tape insertion port 84. Any of the service ports can be smooth bores, threaded bores, or other connection types. As viewed in FIG. 4, cover service plate 46 extends for a portion of a circumference of main body portion 62, which according to several aspects is greater than 50 percent of the circumference of body portion 62.

Figure 5:
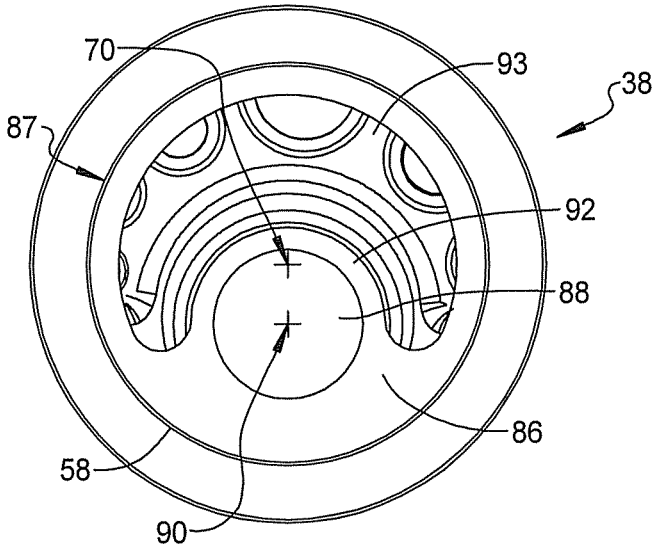
FIG. 5 is a bottom plan view of the well head cover of FIG. 3.

Referring to FIG. 5, and again to FIGS. 1-4, a bottom side or second end wall 86 of well head cover 38 is provided in a normal manufacturing step during roto-molding of well head cover 38 and is therefore integrally connected to well head cover 38. Second end wall 86 extends inwardly from a tubular wall 87 of mounting portion 58. A portion of second end wall 86 is retained through which a second discharge tube bore 88 is created. An axial centerline 90 of second discharge tube bore 88 is coaxially aligned with axial centerline 68 of first discharge tube bore 66, and is therefore also offset with respect to central axis 70 of well head cover 38. The diameters of first and second discharge tube bores 66, 88 are equal and are adapted to slidably receive well discharge pipe 20 including discharge pipe extension 22.

A curved ring or wall 92 is also retained from the originally molded second end wall 86 which partially encloses second discharge tube bore 88, therefore curved wall 92 and second end wall 86, oppositely positioned with respect to first end wall 67, provide two spatially separated contact locations with well discharge pipe 20. These two spaced apart contact locations provide increased structural surface area to retain well discharge pipe 20, including discharge pipe extension 22, in coaxial alignment with axial centerline 90 of second discharge tube bore 88 and axial centerline 68 of first discharge tube bore 66.

Figure 6:
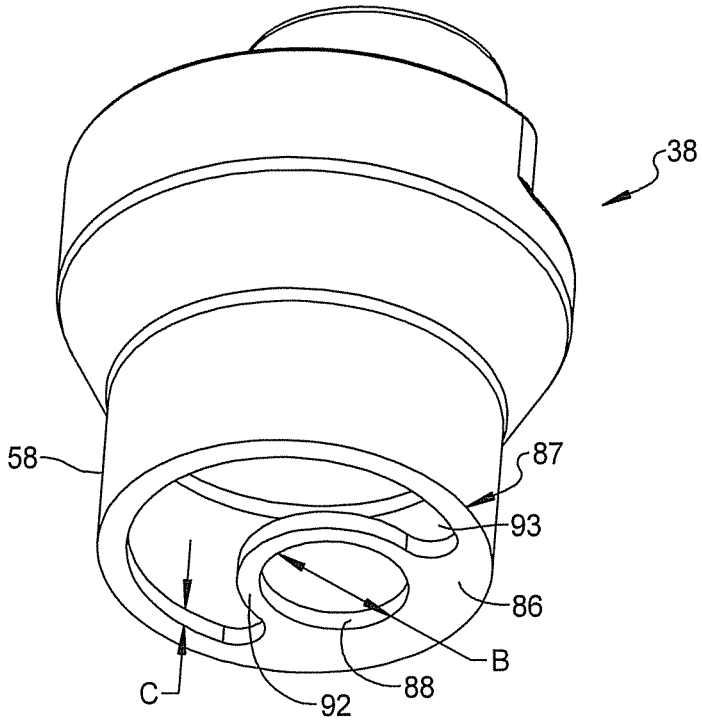
FIG. 6 is a bottom perspective view of the well head cover of FIG. 3.

Referring to FIG. 6 and again to FIGS. 1-5, second discharge tube bore 88 has a diameter "B" which as previously noted equals a diameter of first discharge tube bore 66. Second end wall 86, which includes curved wall 92, has a thickness "C" which according to several embodiments is approximately 0.34 in. Curved wall 92 is created either by removing material of second end wall 86 after the molding operation is complete or by the mold tooling, and creates a kidney or horseshoe-shaped opening 93 between wall 92 and tubular wall 87 of mounting portion 58 providing through access for the other service items described above that are positioned within and/or which extend through well head cover 38.

Referring to FIG. 7, and again to FIGS. 1-6, as previously noted the axial centerlines 68, 90 of the first and second discharge tube bores 66 and 88 are coaxially aligned with each other, allowing a common longitudinal centerline 94 of well discharge pipe 20 and discharge pipe extension 22 to coaxially align with axial centerlines 68, 90. Well discharge pipe 20 and discharge pipe extension 22 are therefore retained in the vertical position shown by direct contact with each of end walls 67 and 86, which thereby structurally supports the weight of all the components connected to well discharge pipe 20 and discharge pipe extension 22, without allowing significant bending or displacement of well discharge pipe 20 and discharge pipe extension 22. Discharge pipe extension 22 is therefore precluded from bending and contacting any of the service lines or components mounted on or proximate to cover service plate 46. As previously noted in reference to FIG. 2, well head cover 38 rests on and is in substantial diametric alignment with the upper end face 33 of well pipe 14. The second end (second end wall 86) of the well head cover 38 is spatially separated from the first end (first end wall 67) of the well head cover by an internal cavity 95. According to several aspects, the well pipe 14 includes end face 33 directly abutted by the second end wall 86 of the well head cover 38 such that no portion of the well head cover 38 extends past the well pipe end face.

Figure 8:
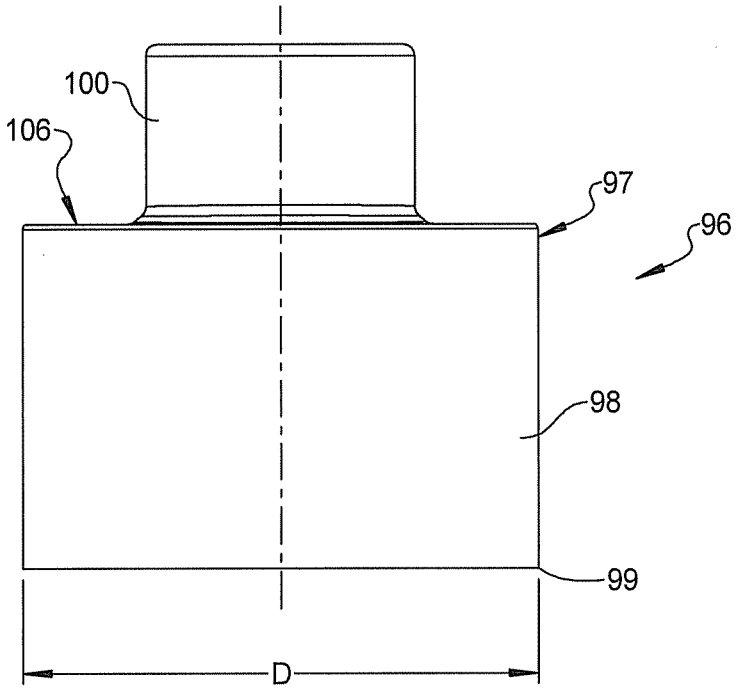
FIG. 8 is a front elevational view of another aspect of a well head cover of the present disclosure.

Referring to FIG. 8, and again to FIGS. 1-7, in a second aspect a well head cover 96 is modified from well head cover 38 to accommodate a larger diameter pipe for well pipe 14, for example to increase well pipe 14 from a six inch to an eight inch pipe size. Well head cover 96 includes a polymeric body 97 made using the same roto-molding process as well head cover 38 but because of its larger diameter and greater internal space for passage of the service pipes and test equipment includes only a tubular shaped main body portion 98 having a diameter "D" suitable for example to coextensively align with an outer wall of an eight inch pipe (schedule 40 or 80), and a tubular shaped discharge portion 100 which is similar in function to discharge portion 64. The main body portion 98 therefore also defines a tubular shaped mounting portion 99 having a mounting portion diameter equal to the main body portion diameter "D", with the mounting portion 99 integrally extending from the main body portion 98.

Figure 9:
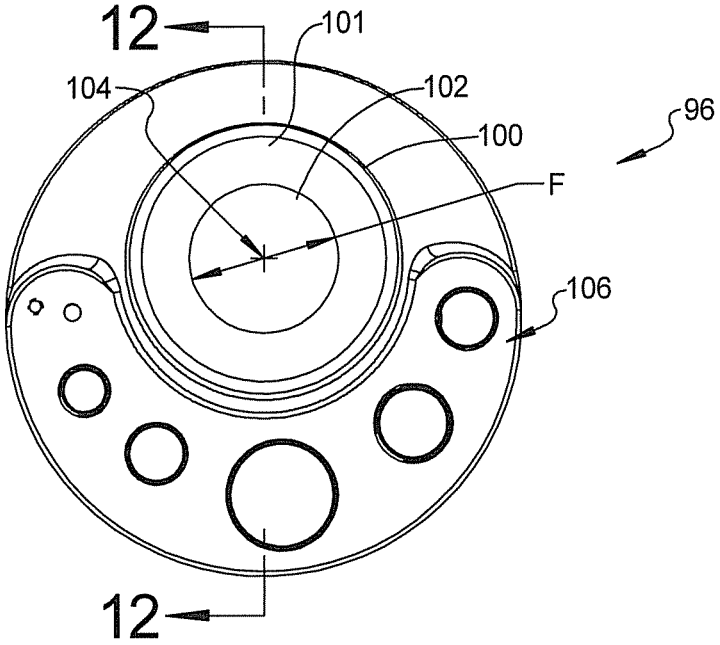
FIG. 9 is a top plan view of the well head cover of FIG. 8.
Figure 10:
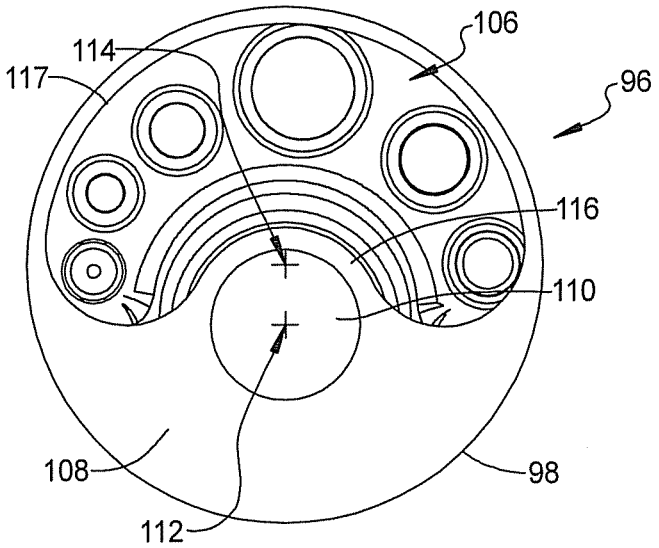
FIG. 10 is a bottom plan view of the well head cover of FIG. 8.

Referring to FIG. 9, and again to FIGS. 1-8, well head cover 96 includes a first end wall 101, having a first discharge tube bore 102 created therein, similar to first discharge tube bore 66. An axial centerline 104 of first discharge tube bore 102 is offset from a body axial centerline 114 (shown in FIG. 10) of main body portion 98. A cover service plate 106, similar in design and orientation to cover service plate 46 is integrally provided with well head cover 96, which therefore also includes multiple service ports to accommodate multiple service lines/pipes or test equipment as previously described in reference to FIG. 4.

Referring to FIG. 10 and again to FIGS. 1-9, similar to well head cover 38, well head cover 96 includes a second end wall 108 defining a first end of well head cover 96, having a second discharge tube bore 110 coaxially aligned with first discharge tube bore 102. An axial centerline 112 of second discharge tube bore 110 is offset with respect to an axial centerline 114 of main body portion 98 by an equal amount as axial centerline 104. Second end wall 108, similar to second end wall 86 includes a curved wall 116 partially enclosing second discharge tube bore 110, which creates a kidney or horseshoe-shaped opening 117.

Figure 11:
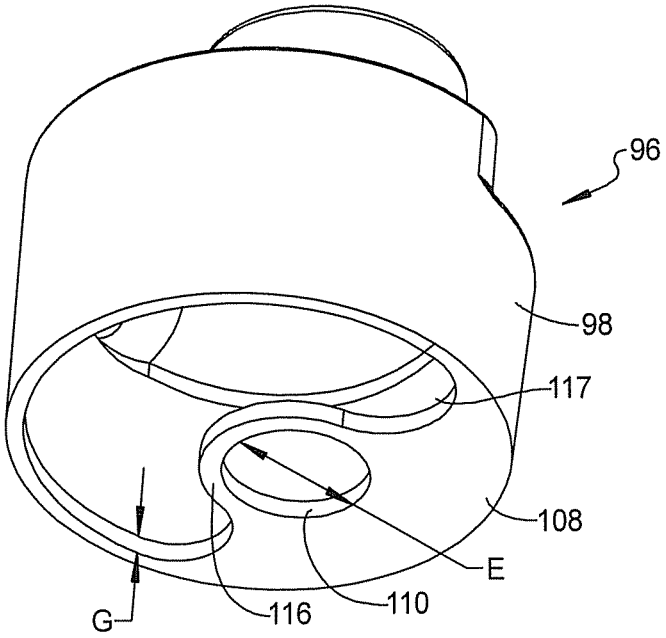
FIG. 11 is a bottom perspective view of the well head cover of FIG. 8.

Referring to FIG. 11 and again to FIGS. 1-10, similar to well head cover 38, the second discharge tube bore 110 of well head cover 96 has a diameter "E" equal to a diameter "F" (shown in FIG. 9) of first discharge tube bore 102. Second end wall 108 including curved wall 116 has a thickness "G" which according to several embodiments is approximately 0.34 in.

Figure 12:
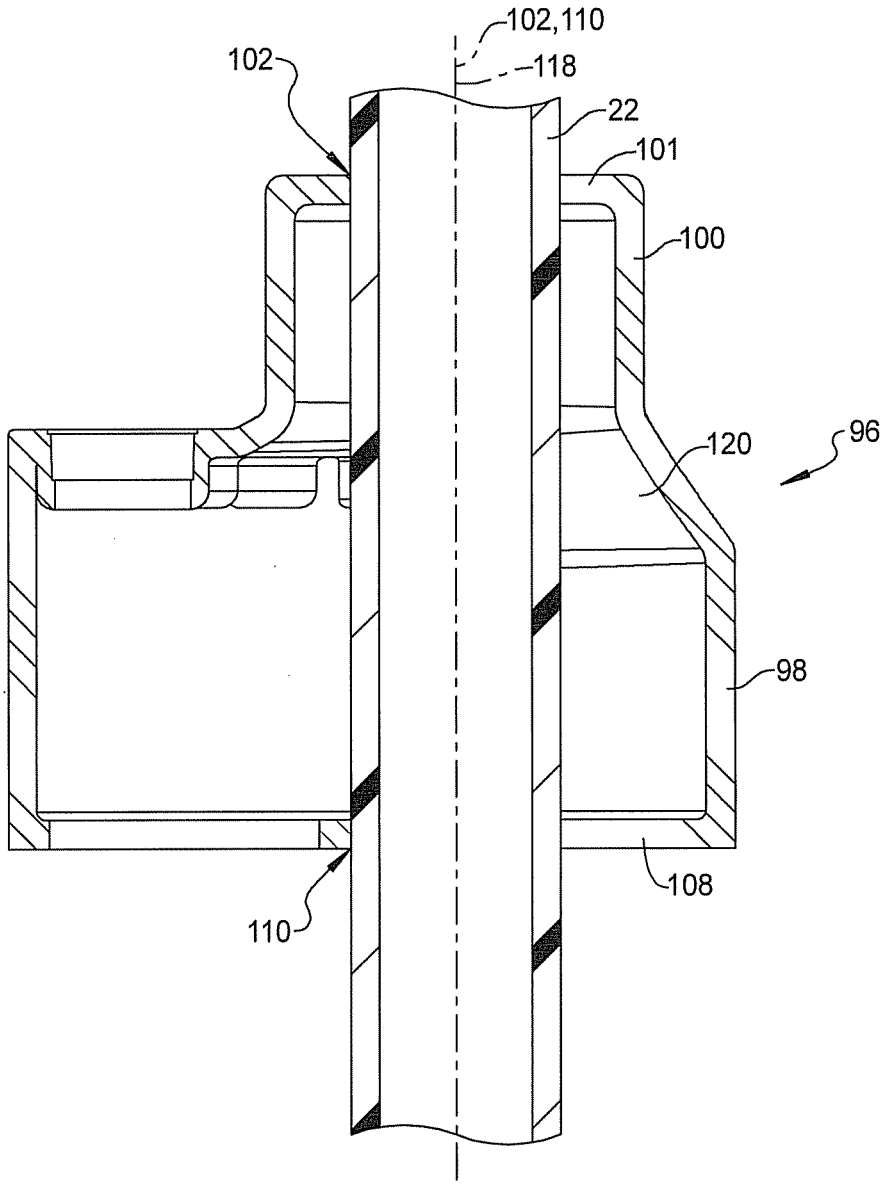
FIG. 12 is a cross sectional side elevational view taken at section 7 of FIG. 9.

Referring to FIG. 12 and again to FIGS. 1-11, as previously noted the axial centerlines 104, 112 of the first and second discharge tube bores 102, 110 are coaxially aligned with each other, allowing a common longitudinal centerline 118 of well discharge pipe 20 and discharge pipe extension 22 to coaxially align with axial centerlines 104, 112. Well discharge pipe 20 and discharge pipe extension 22 are therefore retained in the vertical position shown by direct contact with each of the first and second end walls 101, 108, which thereby prevent significant bending or displacement of the common longitudinal centerline 118 or well discharge pipe 20 with respect to axial centerlines 104, 112. The first and second end walls 101, 108 are spatially separated from each other by an internal cavity 120.

According to several aspects, each of the well head covers 38, 96 includes a polymeric body 45, 97 integrally including each of a tubular shaped main body portion 62, 98 and a tubular shaped mounting portion 58, 99. The mounting portion 58, 99 extends from the main body portion. The tubular shaped discharge portion 64, 100 is connected to the main body portion 62, 98 and is oppositely directed with respect to the mounting portion 58, 99. The first discharge tube bore 66, 102 is created through the first end wall 67, 101 provided in the discharge portion 64, 100. The first end wall 67, 101 defines a first end of the well head cover 38, 96. The second end wall 86, 108 provided in the mounting portion 58, 99 defines a second end of the well head cover 38, 96 spatially separated from the first end of the well head cover by an internal cavity 95, 120. The second end wall 86, 108 has an end wall portion (curved wall 92, 116) through which the second discharge tube bore 88, 110 is created. The axial centerline 90, 112 of the second discharge tube bore 88, 110 is coaxially aligned with the axial centerline 68, 104 of the first discharge tube bore 66, 102.

The present disclosure according to several aspects provides a roto-molded plastic material well head cover that is mounted to and facially abuts the external end face of a well pipe of a landfill where the well head cover can be used to retain the gasses in the well while providing multiple service connections to remove methane produced by the well, as well as for air service, equipment mounting, leachate discharge, and the like. The well head covers of the present disclosure replace known well head cover designs used for this purpose and provide a second discharge pipe sleeve bore integrally created in the well head cover at a location spatially separated from a first discharge pipe bore, thereby providing rigid support to vertically retain the gas discharge pipe. In addition, the roto-molding process used to mold the well head covers allows for any color to be selected for the plastic material, therefore a dynamic, highly visible color can be used.

Well head covers of the present disclosure offer several advantages. Well head covers 10, 96 are made of a molded plastic material having spatially separated first and second end walls each having a bore that slidingly receives a well discharge pipe such that the well discharge pipe is directly and vertically supported at two spatially separated locations of the well head cover, which acts to resist deflection of the discharge pipe and/or components mounted to the well head cover. The geometry provided by the planar cover service plates 46, 106 that partially ring the first and second bores provide substantial wall thickness in a horizontal plane thereby supporting the weight of components mounted to the well head cover. The geometry provided by the curved walls 92, 116 support the well discharge pipe within the body of the well head cover and require no further components, gaskets, seals, or the like within the well head cover. The well head cover is a one-piece, roto-molded plastic that allows a color such as bright yellow to be used for the plastic resin, thereby providing the well head cover in a color that extends throughout the wall thickness of the well head cover, ensuring the color is still retained even if the outer wall surface is damaged, and further obviating the need to paint the well head cover after molding.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A well head cover, comprising:

a polymeric body integrally including each of:

a mounting portion;

a discharge portion;

a first discharge tube bore created through a first end wall provided in the discharge portion, the first end wall defining a first end of the well head cover; and a second end wall provided in the mounting portion defining a second end of the well head cover spatially separated from the first end of the well head cover by an internal cavity, the second end wall having an end wall portion through which a second discharge tube bore is created, an axial centerline of the second discharge tube bore coaxially aligned with an axial centerline of the first discharge tube bore, to enable a well discharge pipe to extend completely through the well head cover, and further such that the first and second discharge tube bores have a common predetermined diameter, with the common predetermined diameter being just slightly larger than a diameter of the well discharge pipe to allow the well head cover to help support and maintain the well discharge pipe in a vertically oriented position;

wherein the second end wall further includes an independent opening adjacent the second discharge tube bore.

2. The well head cover of claim 1, further including a tubular shaped main body portion positioned between and integrally connecting the mounting portion to the discharge portion, wherein both the axial centerline of the second discharge tube bore and the axial centerline of the first discharge tube bore are equally offset with respect to an axial centerline of the well head cover.

3. The well head cover of claim 2, wherein the first discharge tube bore and the second discharge tube bore slidably receive the well discharge pipe such that the well discharge pipe directly contacts a wall of each of the first and second discharge tube bores.

4. The well head cover of claim 2, further including a cover service plate located at a junction between the main body portion and the discharge portion, the cover service plate including multiple service ports.

5. The well head cover of claim 4, wherein the cover service plate is substantially planar and U-shaped shaped and is oriented substantially perpendicular to a longitudinal central axis of the main body portion.

6. The well head cover of claim 4, wherein the multiple service ports created in the cover service plate include at least a plurality of:

a first threaded aperture adapted to receive a first threaded fastener;

a second threaded aperture adapted to receive a second threaded fastener;

an air inlet port;

an air outlet port;

a leachate discharge port;

a differential pressure or liquid level probe port; and a manual liquid level tape insertion port.

7. The well head cover of claim 2, further including a cover service plate located at a junction between the main body portion and the discharge portion, the cover service plate extending for a portion of a circumference of the main body portion greater than 50 percent of the circumference.

8. The well head cover of claim 2, further including a conical shaped portion positioned between and integrally joining the mounting portion and the main body portion.

9. The well head cover of claim 2, wherein the mounting portion is oriented concentric to the main body portion.

10. The well head cover of claim 2, wherein both the first end wall and the second end wall are oriented perpendicular to a longitudinal central axis of the main body portion.

11. The well head cover of claim 2, wherein the main body portion is concentric with respect to the axial centerline of the well head cover.

12. The well head cover of claim 1, further including the independent opening comprises a horseshoe-shaped opening created in the second end wall between the end wall portion and a tubular wall of the mounting portion providing through access for multiple service items extending through the internal cavity.

13. The well head cover of claim 1, wherein the end wall portion includes a curved wall which partially encloses the second discharge tube bore.

14. The well head cover of claim 13, wherein the second end wall, which includes the curved wall of the end wall portion, has have a thickness of approximately 0.34 in.

15. A well head cover, comprising:

a polymeric body integrally including each of:

a tubular shaped main body portion;

a tubular shaped mounting portion extending from the main body portion;

a tubular shaped discharge portion connected to the main body portion oppositely directed with respect to the mounting portion;

a first discharge tube bore created through a first end wall provided in the discharge portion; and a second end wall provided in the mounting portion, the second end wall having an end wall portion through which a second discharge tube bore is created, an axial centerline of the second discharge tube bore coaxially aligned with an axial centerline of the first discharge tube bore to enable a well discharge pipe to extend completely through the well head cover, and further such that the first and second discharge tube bores have a common predetermined diameter, with the common predetermined diameter being just slightly larger than a diameter of the well discharge pipe to allow the well head cover to help support and maintain the well discharge pipe in a vertically oriented position.

16. The well head cover of claim 15, wherein the mounting portion has a mounting portion diameter smaller than a main body portion diameter.

17. The well head cover of claim 15, wherein the mounting portion has a mounting portion diameter equal to a main body portion diameter.

18. The well head cover of claim 15, wherein the first end wall defines a first end of the well head cover and the second end wall defines a second end of the well head cover, the second end spatially separated from the first end by an internal cavity.

19. A well head cover assembly, comprising:

a polymeric well head cover integrally including each of:

a mounting portion;

a discharge portion;

a first discharge tube bore created through a first end wall provided in the discharge portion, the first end wall defining a first end of the well head cover and having a cover service plate with a plurality of service ports for securing a plurality of external tubes thereto; and a second end wall provided in the mounting portion defining a second end of the well head cover spatially separated from the first end of the well head cover by an internal cavity, the second end wall having an end wall portion through which a second discharge tube bore is created, an axial centerline of the second discharge tube bore coaxially aligned with an axial centerline of the first discharge tube bore;

the second end wall further including an opening spaced apart from the second discharge tube bore and being generally circumferentially aligned with said cover service plate, to enable at least one tubular component to pass through the second end wall and to communicate with one of the service ports in the cover service plate; and the first and second discharge tube bores having a common diameter enabling a well discharge pipe to extend completely through the well head cover.

20. The well head cover assembly of claim 19, further including:

a well pipe having the well discharge pipe further extending into the well pipe; and the well pipe including an end face directly abutted by the second end wall of the well head cover with no portion of the well head cover extending past the well pipe end face.

21. The well head cover assembly of claim 20, wherein the well pipe and the second end wall of the mounting portion are substantially equal in diameter such that a tubular-shaped resilient material connecting boot externally slidably received over both the well pipe and the mounting portion acts to connect the well head cover to the well pipe, wherein the well head cover is removable from the well pipe by releasing first and second band straps frictionally connecting the boot to both the well pipe and the well head cover.

22. The well head cover assembly of claim 19, further including:

a main body portion of the polymeric well head cover positioned between and integrally connecting the mounting portion to the discharge portion; and wherein the cover service plate is located at a junction between the main body portion and the discharge portion.

23. The well head cover assembly of claim 22, wherein the plurality of service ports provides for connection of at least one of: a bracket retaining a filter/regulator of an air supply system, a tube supporting a well fluid level detector, and a connector for an external well fluid discharge pipe.

24. The well head cover assembly of claim 22, wherein the plurality of service ports provides for connection of a supply air line and an air discharge line.

25. The well head cover assembly of claim 19, wherein the coaxially aligned axial centerlines of the first and second discharge tube bores allow a common longitudinal centerline of the well discharge pipe to be coaxially aligned with the axial centerline of each of the first and second discharge tube bores, wherein direct contact between the well discharge pipe and both the first and second end walls prevents substantial displacement of the longitudinal centerline of the well discharge pipe away from the axial centerlines of the first and second discharge tube bores.

26. The well head cover assembly of claim 19, further including a curved wall defining a portion of the second discharge tube bore of the second end wall, the curved wall and the first discharge tube bore of the first end wall providing two spatially separated contact locations with the well discharge pipe.

* * * * *

UNITED STATES PATENT AND TRADEMARK OFFICE

CERTIFICATE OF CORRECTION

PATENT NO. : 9,068,421 B2
APPLICATION NO. : 13/658433
DATED : June 30, 2015
INVENTOR(S) : Douglas D. Colby et al.

It is certified that error appears in the above-identified patent and that said Letters Patent is hereby corrected as shown below:

Claims

Column 9, Claim 14, Line 18: - after “has” delete “have”, therefor.

Signed and Sealed this
Twenty-ninth Day of December, 2015

Michelle K. Lee

Michelle K. Lee
*Director of the United States Patent and Trademark Office*